US006170360B1

(12) United States Patent
Smith

(10) Patent No.: US 6,170,360 B1
(45) Date of Patent: Jan. 9, 2001

(54) TOOL FOR SAFELY REMOVING CLIP ON PRE-OPENED HOSE CLAMPS

(75) Inventor: Gary M. Smith, Waterford, MI (US)

(73) Assignee: DaimlerChrysler Corporation, Auburn Hills, MI (US)

( * ) Notice: Under 35 U.S.C. 154(b), the term of this patent shall be extended for 0 days.

(21) Appl. No.: 09/406,375

(22) Filed: Sep. 28, 1999

(51) Int. Cl.[7] ..... B25B 27/10
(52) U.S. Cl. ..... 81/9.3; 81/488; 29/243.56
(58) Field of Search ..... 81/9.3, 488; 29/243.56

(56) References Cited

U.S. PATENT DOCUMENTS

| | | | | |
|---|---|---|---|---|
| 3,800,634 | | 4/1974 | Clayton . | |
| 4,003,238 | | 1/1977 | Oetiker . | |
| 4,368,569 | | 1/1983 | Van Dam, Jr. . | |
| 4,919,017 | | 4/1990 | Thomas . | |
| 4,999,899 | * | 3/1991 | Sawyer | 29/243.56 |
| 5,209,143 | | 5/1993 | Sweet . | |
| 5,507,206 | | 4/1996 | Solski . | |
| 5,542,155 | | 8/1996 | Kimura et al. . | |
| 5,870,811 | * | 2/1999 | Ciok | 29/229 |
| 6,018,856 | * | 2/2000 | Ehrhart | 29/235 |

* cited by examiner

*Primary Examiner*—James G. Smith
*Assistant Examiner*—Hadi Shakeri
(74) *Attorney, Agent, or Firm*—Roland A. Fuller, III

(57) ABSTRACT

A tool for removing a retainer from the opposed tangs of a spring-type hose clamp is provided. The tool includes a first member adapted to fit between the retainer and the hose clamp and dislodge the retainer from the tangs of the hose clamp. The tool also includes a second member adapted to retain the retainer to the first member after the removal of the retainer from the hose clamp. A method for employing the tool is also provided.

15 Claims, 3 Drawing Sheets

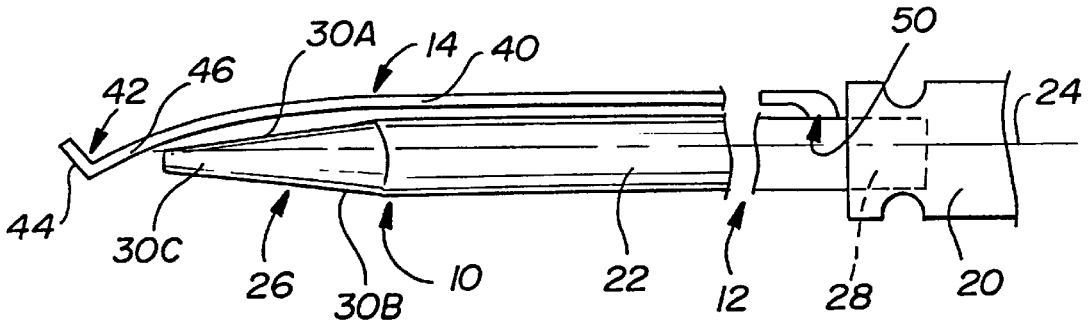
Fig-1
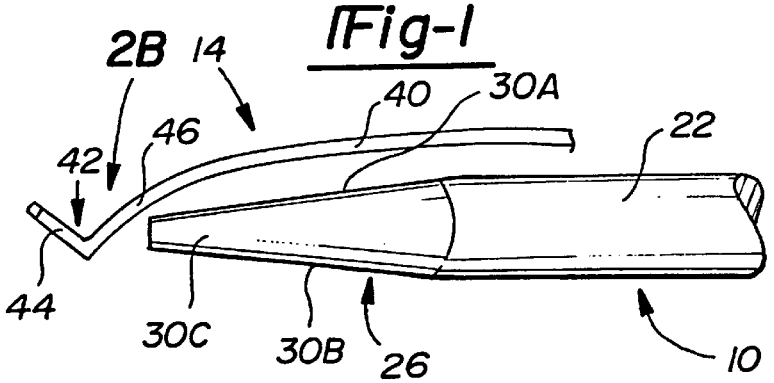
Fig-2A
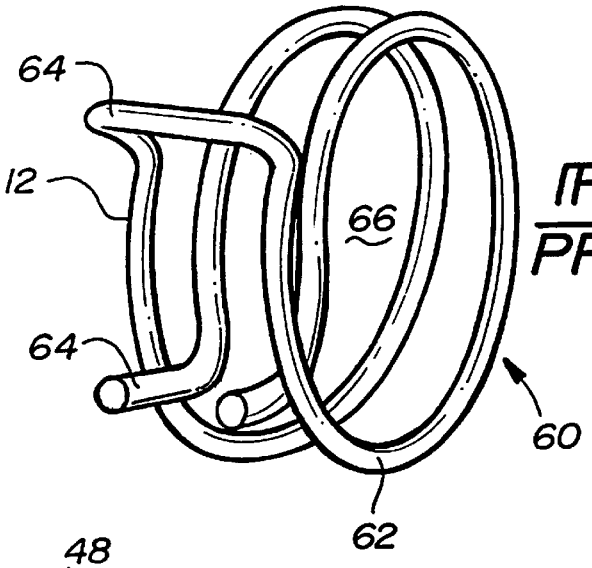
Fig-3A
PRIOR ART
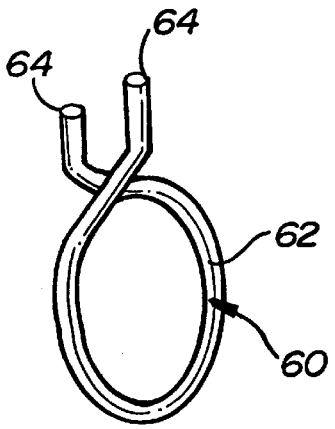
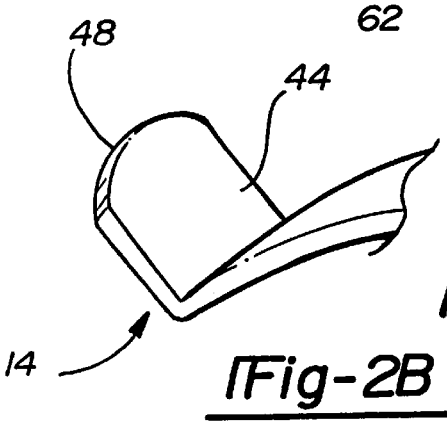
Fig-3B
PRIOR ART
Fig-2B

TOOL FOR SAFELY REMOVING CLIP ON PRE-OPENED HOSE CLAMPS

BACKGROUND OF THE INVENTION

1. Technical Field

The present invention relates generally to assembly tooling and more particularly to tooling for the installation of hose clamps.

2. Discussion

It is common place in the manufacture of modern vehicles to utilize flexible hoses to direct various vehicle fluids in a desired manner. As compared to rigid fluid conduits, flexible hoses are generally low in cost and easily installed and serviced. Despite the advantages of flexible hoses, several drawbacks have been noted.

One particular drawback concerns the labor required to subassemble and install a hose, particularly where engine or vehicle components are in close proximity to one another and render conventional hose clamp repositioning tools difficult to employ. The subassembly operation typically requires that a pair of hose clamps be opened or spread sufficiently and installed to the ends of the hose. Thereafter, the assembly is positioned in a desired manner, the ends of the hose are coupled to various fluid connectors and the clamps are opened a second time and repositioned over portions of the hose that are adjacent to the connectors.

In areas where engine or vehicle components are in close proximity to one another, a substantial amount of labor may be expended to reposition the hose clamp in a desired manner. The labor associated with the first opening of the clamps and their initial positioning does not add value to the device manufactured and as such, unnecessarily increases the cost of the vehicle. Furthermore, as the task of opening and repositioning each of the clamps is performed manually, this operation increases the risk that the device manufactured will have a defect, such as an improperly relocated clamp. Such defects require additional labor efforts to diagnose and repair.

To alleviate these problems, a retainer has been developed which engages the tangs of the spring-type hose clamps when the clamp is positioned in an expanded condition. The retainer effectively eliminates the need to re-open or spread the hose clamps to permit the hose to be installed to the connectors. Furthermore, the labor associated with repositioning has been eliminated through the use of retaining means which cause the hose clamp to be retained in a given area of the hose while it is being retained in an expanded condition. Such retaining means include adhesives or mechanical fastening.

While the use of the retainer has improved the efficiency with which a spring-type hose clamp may be installed in some situations, a new problem, the removal of the retainer in a controlled manner, was encountered. More specifically, while the retainer was easily pried from the tangs of the hose clamp, the energy released by the retainer as it was removed generally caused the retainer to be propelled away from the hose and clamp. Consequently, the issues with the uncontrolled removal of the retainer included the loss of the retainer, damage to the device manufactured as a result of the retainer impacting or becoming lodged into the device, and the safety of the technician installing the hose and those in the surrounding area.

SUMMARY OF THE INVENTION

It is one object of the present invention to provide a tool for removing a retainer from a spring-type hose clamp which retains the retainer subsequent to its removal.

It is another object of the present invention to provide a tool for removing a retainer from a spring-type hose clamp which utilizes a resiliently biased member to retain the retainer to the tool.

It is another object of the present invention to provide a method for installing a hose assembly having a spring-type hose clamp.

A tool for removing a retainer from the opposed tangs of a spring-type hose clamp is provided. The tool includes a first member adapted to fit between the retainer and the hose clamp and dislodge the retainer from the tangs of the hose clamp. The tool also includes a second member adapted to retain the retainer to the first member after the removal of the retainer from the hose clamp. A method for employing the tool is also provided.

Additional advantages and features of the present invention will become apparent from the subsequent description and the appended claims, taken in conjunction with the accompanying drawings.

BRIEF DESCRIPTION OF THE DRAWINGS

FIG. 1 is a perspective view of a tool constructed in accordance with the teachings of the present invention;

FIG. 2 is an enlarged portion of the tool of FIG. 1;

DETAILED DESCRIPTION OF THE PREFERRED EMBODIMENT

Figure 3C:
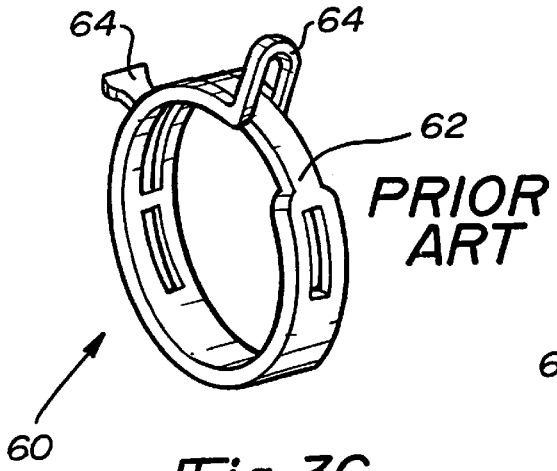
PRIOR ART Fig-3C
FIG. 3 is a perspective view of various spring-type hose clamps.
Figure 3D:
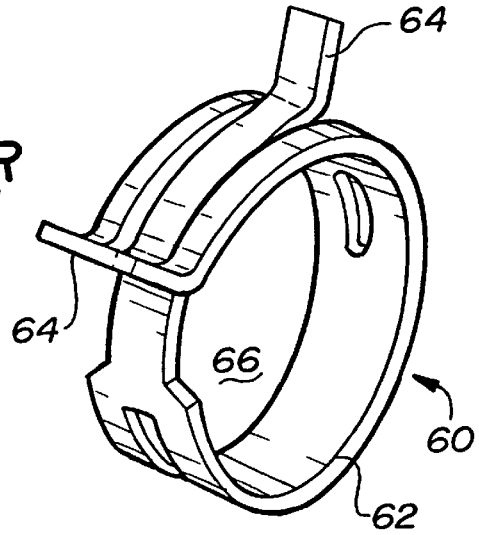
Fig-3D PRIOR ART
Figure 3E:
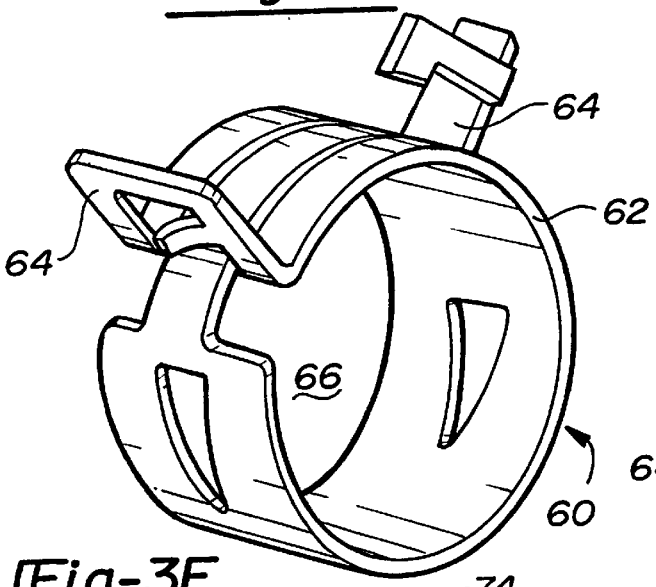
Fig-3E PRIOR ART
Figure 3F:
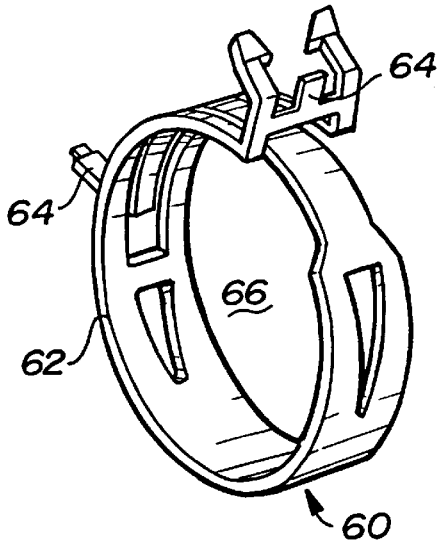
Fig-3F PRIOR ART

Referring now to the FIGS. 1 and 2 of the drawings, a tool constructed in accordance with the teachings of the present invention is generally indicated by reference numeral 10. Tool 10 includes a first member 12 and a second member 14. First member 12 includes a handle 20 and a body portion 22 having a longitudinal axis 24 and first and second ends 26 and 28. Handle 20 is ergonomically shaped to permit a technician to operate tool 10 in a twisting or prying motion as desired. Body portion 22 is fixedly coupled to handle 20 at second end 28. First end 26 includes at least one engagement surface 30 which tapers inwardly toward longitudinal axis 24. In the particular embodiment illustrated, first member 12 is a slotted (or flat bladed) screwdriver and first end includes engagement surfaces 30*a*, 30*b*, 30*c* and 30*d* which are conventionally formed of the drive end of such screwdrivers.

Second member 14 is coupled to first member 12 includes a retaining portion 40 and an insertion portion 42. Retaining portion 40 is coupled to first member 12 and extends axially along body portion 22 parallel to longitudinal axis 24. Insertion portion 42 is generally V-shaped and includes a first portion 44 and a second portion 46. First portion 44 depends upwardly away from longitudinal axis 24 and preferably includes a rounded or tapered leading edge 48. Second portion 46 fixedly couples first portion 44 to retaining portion 40. Retaining portion 40 preferably biases insertion portion 42 toward longitudinal axis 24.

Second member 14 may be fabricated from any structural material, such as a metalloid, a metal or a plastic material.

An appropriate fastening means 50 is then employed to secure second member 14 to first member 12. Examples of such fastening means 50 includes welding, mechanical fasteners, adhesives and adhesive tapes. In the particular embodiment illustrated, second member 14 is fabricated from a steel material and has a length of about 6 inches, a width of about 0.5 inches and a thickness of about 0.015 inches. Second member 14 is welded to body portion 22.

In FIG. 3, several types of spring-type hose clamps are illustrated. With particular reference to FIG. 3D, hose clamp 60 is illustrated to include a clamp body 62 and a pair of opposed tangs 64 which are fixedly coupled to clamp body 62. Hose clamp 60 is operable between a retracted condition, wherein the interior 66 of hose clamp 60 has a first diameter, and an expanded condition, wherein the interior 66 of hose clamp 60 has a second diameter larger than the first diameter. Hose clamp 60 is formed from a flat spring steel which resiliently biases hose clamp 60 to the retracted condition. Application of a force to both of the tangs 64 in excess of a predetermined magnitude causes the tangs 64 to move toward one another and expand the interior 66 of hose clamp 60. Withdrawal of the force to the tangs 64 causes the tangs 64 to move away from one another and retract the interior 66 of hose clamp 60.

Figure 4:
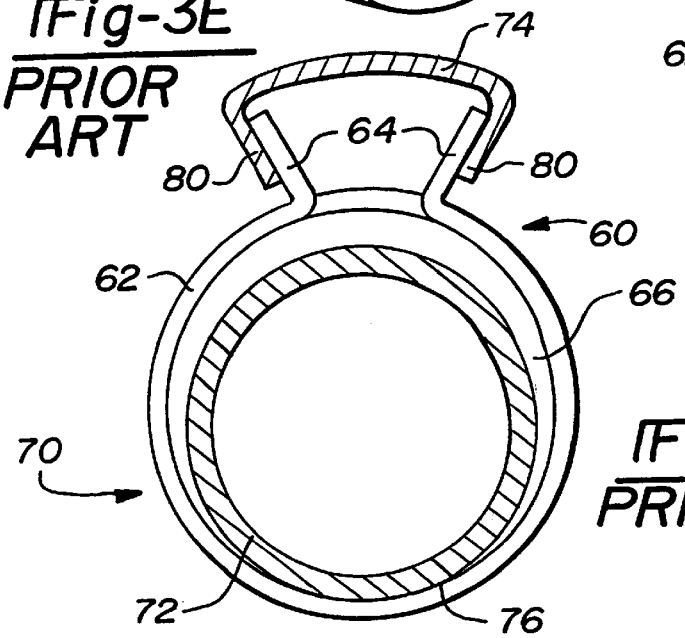
Fig-4 PRIOR ART
FIG. 4 is a cross-sectional view of a spring-type hose clamp as coupled to a hose and retained in an expanded condition.

In FIG. 4, a hose assembly 70 is illustrated in cross section. Hose assembly 70 includes hose clamp 60, a hose 72, a retainer 74, and a hose clamp securing means 76. In the particular embodiment illustrated, hose clamp securing means 76 is a super glue (ethyl cyanoacrylate) material which permits a portion of hose clamp 60 to be adhesively bonded to hose 72. Preferably, the super glue material sublimes at elevated temperatures to permit hose clamp 60 to be removed from hose 72 for subsequent servicing. PERMATEX® Super Glue GELMATIC manufactured by Loctite Corporation is one such super glue material. Alternatively, hose clamp securing means 76 may be a conventional mechanical fastener.

Retainer 74 is conventional in construction and a detailed description need not be provided herein. Briefly, retainer 74 is relatively rigid structure having a generally U-shaped construction. The fork members 80 of retainer 74 are spaced apart a predetermined distance and are configured to engage the tangs 64 of hose clamp 60 when the hose clamp 60 has been positioned in an expanded position. Retainer 74 is therefore operable for inhibiting the movement of tangs 64 in a separating or spreading direction and prevents hose clamp 60 from returning to the retracted position. Retainer 74 is described in more detail in U.S. Pat. No. 5,507,206 which is hereby incorporated by reference as if fully set forth herein.

Figure 5:
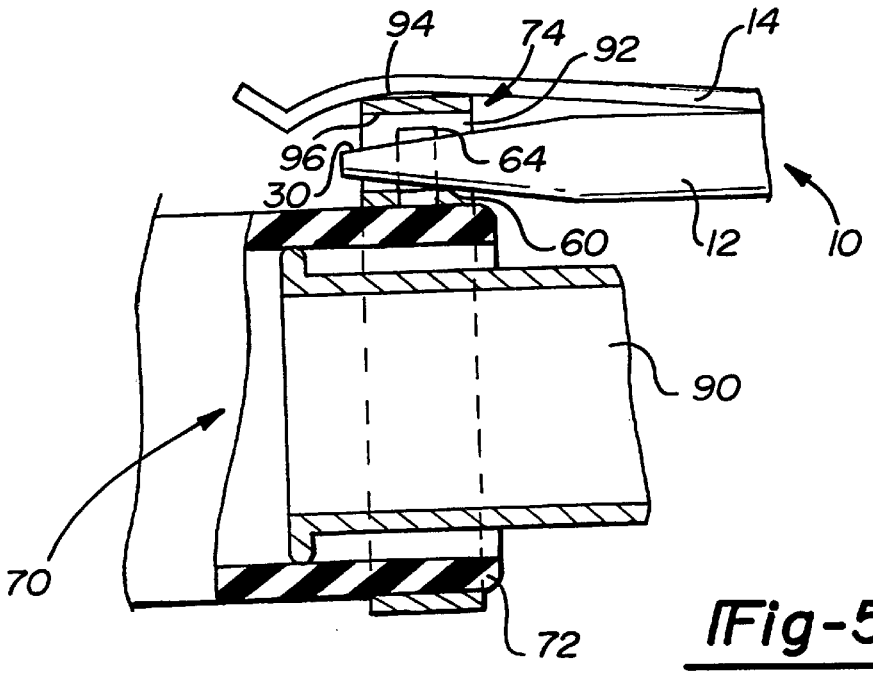
FIG. 5 is a cross-sectional view of the tool of FIG. 1 in operative association with a spring-type hose clamp and a retainer.

In FIG. 5, tool 10 is shown in operative association with hose assembly 70. Hose assembly 70 is initially installed to a fluid connector 90 such that hose 72 is positioned over connector 90. Tool 10 is then placed proximate hose clamp 60 and the first end 26 of first member 12 is inserted into the void 92 between hose clamp 60 and retainer 74. As first end 26 is being inserted into void 92, the first portion 44 of insertion portion 42 contacts retainer 74 and guides second member 14 along the top surface 94 of retainer 74. Further insertion of first member 12 into void 92 causes insertion portion 42 to slide over top surface 94 and trap retainer 74 between first member 12 and retaining portion 40. Handle 20 is then manipulated in either a levering motion or a rotating motion to cause one of the engagement surfaces 30 to contact the bottom surface 96 of retainer 74 and forcibly withdraw retainer 74 from tangs 64.

Removal of retainer 74 from hose clamp 60 allows tangs 64 to move relative to one another and permits hose clamp 60 to return to the retracted position. Clamp body 62 is then operable for exterting a clamping force on the perimeter of hose 72, causing hose 72 to forcibly contact connector 90 and create a seal therebetween in a conventional manner. As retainer 74 is trapped between first and second members 12 and 14, the energy stored in retainer 74 is permitted to dissipate when it is removed from hose clamp 60 without propelling retainer 74 away from hose assembly 70. Retainer 74 is thereafter removed from tool 10 and returned to the area fabricating hose assemblies for re-use.

Figure 6:
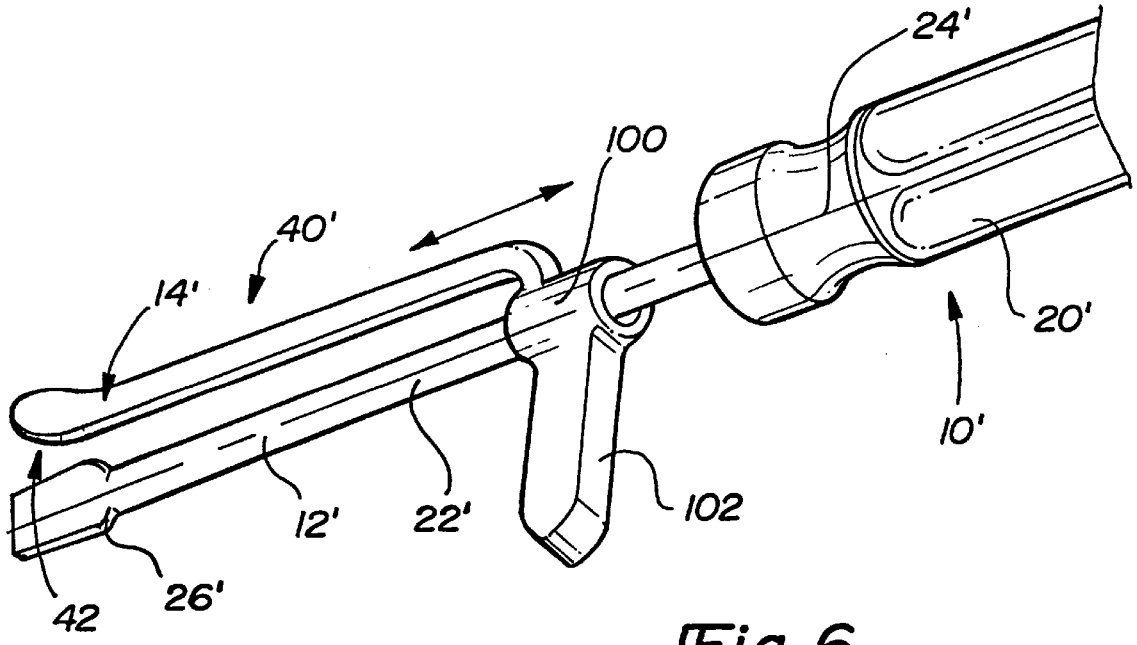
FIG. 6 is a perspective view of another tool constructed in accordance with the teachings of the present invention.

While the tool of the present invention has been described thus far as having a second member fixedly coupled to the first member, those skilled in the art will appreciate that the invention, in its broader aspects, may be constructed somewhat differently. For example, as illustrated in FIG. 6, second member 14' may be slidingly engaged to first member 12'. In this arrangement, retaining portion 40' includes a clip structure 100 adapted to slidingly engage body portion 22'. Clip structure 100 includes extension means 102 which is adapted to receive a force exerted by the thumb of a technician. In response to the application of force to extension means 102, second member 14' is caused to slide across body portion 22' along longitudinal axis 24'. In operating tool 10', first end 26' is initially placed in void 92. A force is next applied to extension means 102 and second member 14' is pushed toward hose clamp 60 until insertion portion 42' has traveled over top surface 94 and retaining portion 40 has engaged retainer 74.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

I claim:

1. A tool for removing a retainer device from a spring-type hose clamp, the retainer device retaining the spring-type hose clamp in a generally open condition, the tool comprising:

a first member having a longitudinally extending body portion with a first end, the first end having at least one surface which tapers inwardly toward a longitudinal axis of the body portion; and a second member coupled to the first member, the second member extending from the first member in a direction parallel to the longitudinal axis of the body portion such that a distal end of the second member extends over the first end of the body portion;

wherein the first end of the first member is adapted to fit between the retainer and the hose clamp and the second member is adapted to fit over the retainer such that the second member inhibits movement of the retainer when the first member is caused to dislodge the retainer from the hose clamp.

2. The tool of claim 1, wherein the first member is a slotted (or flat bladed) screwdriver.

3. The tool of claim 1, wherein the second member includes an insertion portion adapted to guide the second member over the retainer.

4. The tool of claim 3, wherein the second member is in sliding engagement with the body portion.

5. The tool of claim 3, wherein the second member further includes a retaining portion coupled to the insertion portion, the retaining portion biasing the insertion portion toward the longitudinal axis of the body portion.

6. The tool of claim 5, wherein the insertion portion includes first and second portions, the first portion spaced apart from and extending generally away from the longitudinal axis, the second portion extending downwardly toward the longitudinal axis and past the first end.

7. The tool of claim 1, wherein the second member is formed from a metal material.

8. The tool of claim 7, wherein the second member is formed from a steel material.

9. The tool of claim 8, wherein the second member is formed from a spring steel material.

10. The tool of claim 1, wherein the second material is formed from a plastic material.

11. The tool of claim 1, wherein the second material is formed from a metalloid material.

12. A tool for removing a retainer device from a spring-type hose clamp, the hose clamp having a pair of opposed tangs adapted to expand the interior circumference of the hose clamp in response to the application of a predetermined force thereto, the retainer device coupled to the pair of opposed tangs and retaining the hose clamp in a generally open condition, the tool comprising:

a first member having a handle and a longitudinally extending body portion, the body portion including first and second ends, the first end having a surface which tapers inwardly toward a longitudinal axis of the body portion, the second end fixedly coupled to the handle;

a second member coupled to the first member and having a retainer portion and an insertion portion, the retainer portion extending along the first member in a direction parallel the longitudinal axis of the body portion, the insertion portion including first and second portions, the first portion spaced apart from and extending generally away from the longitudinal axis, the second portion extending downwardly toward the longitudinal axis and past the first end, the insertion portion adapted to guide the retainer portion over the retainer, the retaining portion biasing the insertion portion toward the longitudinal axis of the body portion;

wherein the first end of the first member is adapted to fit between the retainer and the hose clamp and the retaining portion is adapted to fit over the retainer such that when the first member is caused to dislodge the retainer from the hose clamp, the second member inhibits movement of the retainer.

13. The tool of claim 12, wherein the first member is a screwdriver.

14. The tool of claim 12, wherein the second member is in sliding engagement with the first member.

15. A method for coupling a hose to a hose coupling comprising the steps of:

providing a spring-type band clamp operable between a fully retracted condition, wherein the interior circumference of the band clamp has a first diameter, and an expanded condition, wherein the interior circumference of the band clamp has a diameter larger than the first diameter, the spring-type band clamp including a pair of opposed tangs adapted to expand the interior circumference of the band clamp in response to the application of a predetermined force thereto;

coupling the band clamp to a first end of the hose;

coupling a retainer to the tangs of the band clamp to retain the band clamp in the expanded condition;

coupling the first end of the hose to the hose coupling;

providing a tool having a first member, a handle and a second member, the first member having a longitudinally extending body portion with first and second ends, the first end having at least one surface which tapers inwardly toward the longitudinal axis of the body portion, the handle coupled to the second end of the body portion and the second member coupled to the first member, the second member extending from the first member in a direction parallel the longitudinal axis of the body portion such that a distal end of the second member extends over the first end of the body portion;

coupling the tool to the retainer such that the first end is inserted between the retainer and the hose clamp and the second member is positioned over the retainer; and removing the retainer from the pair of opposed tangs with the first end such that the retainer is retained between the first and second members.

* * * * *